United States Patent [19]

Takeuchi et al.

[11] Patent Number: 4,830,090

[45] Date of Patent: May 16, 1989

[54] METHOD OF CONTINUOUSLY CASTING LEAD-BEARING STEEL

[75] Inventors: Hidemaro Takeuchi; Shogo Matsumura; Harumi Tsuboi; Masao Yamamiya, all of Hikari, Japan

[73] Assignee: Nippon Steel Corporation, Tokyo, Japan

[21] Appl. No.: 147,341

[22] Filed: Jan. 22, 1988

[30] Foreign Application Priority Data

Mar. 6, 1987 [JP] Japan ..... 62-50124

[51] Int. Cl.[4] ..... B22D 11/10

[52] U.S. Cl. ..... 164/488; 164/134; 164/437; 75/46

[58] Field of Search ..... 164/134, 337, 437, 488, 164/489; 75/46, 51.7, 53

[56] References Cited

U.S. PATENT DOCUMENTS 4,754,800 7/1988 Jackson et al. ..... 164/134

FOREIGN PATENT DOCUMENTS 0212856 3/1987 European Pat. Off. .
3425081 1/1986 Fed. Rep. of Germany .
95190 7/1970 France ..... 164/437
2214544 8/1974 France .
57-17357 1/1982 Japan ..... 164/488
58-43312 7/1983 Japan ..... 75/51.7
2147837 5/1985 United Kingdom .

OTHER PUBLICATIONS

European Search Report, No. EP 88 30 1237, dated 09/21/88.

Patent Abstracts of Japan, vol. 6, No. 80 (M—129), [958] of 05/19/82.

*Primary Examiner*—Richard K. Seidel

*Attorney, Agent, or Firm*—Wenderoth, Lind & Ponack

[57] ABSTRACT

A method of continuously casting lead-bearing steel by adding lead to steel melt in a tundish. The tundish is divided into a plurality of chambers including a melt receiving chamber and an immersed nozzle chamber, lead is supplied to the molten steel in a chamber other than the immersed nozzle chamber so as to form a lead sediment layer at the bottom thereof, and molten steel containing suspended Pb is passed to the immersed nozzle chamber from where it is poured into a mold of the continuous caster.

3 Claims, 3 Drawing Sheets

METHOD OF CONTINUOUSLY CASTING LEAD-BEARING STEEL

BACKGROUND OF THE INVENTION

1. Field of the Invention

This invention relates to a method of continuously casting lead-bearing steel and more particularly to a method of continuously casting lead-bearing steel which enables lead to be uniformly and stably incorporated into a continuously cast steel strand.

2. Description of the Prior Art

The improved machinability of free-cutting steels is the result of the addition to such steels of an element such as S, Pb or Bi. Among these elements, Pb, is found particularly difficult to incorporate into the steel uniformly and stably. This is because Pb has a high specific gravity and poor solubility in steel.

The amount of Pb required to be added to a Pb-bearing free-cutting steel falls in the range of 0.1–0.4%. In contrast, the solubility of Pb in steel is said to be 0.17% in 18Cr-8Ni stainless steel and 0.08% i n 13Cr stainless steel at 1550° C. (Denki-Seiko (Electric Furnace Steel), 34(19863)2, p128), figures which show that Pb solubility is especially low in ferritic stainless steel. Because of this, it is necessary to add small particles of metallic Pb to the molten steel in excess of the soluble amount to get a dispersion.

In the past, the most commonly used method of producing lead-bearing steel has been that of adding Pb to the melt in the ladle and then casting the melting into ingots. With this method, however, the Pb undergoes gravity segregation in the ladle and, as a result, the chemical composition of the steel varies with the passage of casting time. Moreover, the distribution of lead varies between the top and bottom of the individual ingots.

On the other hand, there have been atttempts in recent years to carry out the addition of Pb by the continuous casting method. In this case, it is conceivable to add the Pb to the steel in the ladle, in the mold, or in the tundish. Each of these methods has some drawbacks.

When the addition is carried out in the ladle, the lead distribution varies between the top and bottom of the strand, similarly to what was mentioned above.

In the case of adding the lead in the mold, the added lead becomes trapped by the powder layer when passing therethrough and also escapes from the melt by evaporation. The addition yield is thus low and it is therefore difficult to realize a Pb content within the prescribed range. Another problem arises in that coarse particles of Pb formed in the mold settle out, resulting in the formation of coarse Pb grains in the strand as well as uneven lead distribution.

Where the addition is carried out in the tundish, the Pb precipitating at the bottom of the tundish is entrained by the flow of melt into the mold, as are the coarse Pb particles which settle out. Coarse grains of Pb are thus formed in the strand and the lead distribution becomes uneven.

As ways for preventing the Pb precipitated at the bottom of the tundish from being entrained by the flow of melt into the mold, Japanese unexamined Patent Publication No. 58(1983)-154446 proposes a method in while the inlet of the nozzle is positioned at a high level, which Japanese unexamined Patent Publication No. 61(1986)-144250 proposes a method wherein the precipitated Pb is recovered by being passed through porous brick provided at the bottom of the tundish, thus preventing the formation of a precipitated layer of lead at the bottom of the tundish. However, neither method is able to prevent the formation of Pb grains in the strand that is caused when sedimenting coarse Pb grains are entrained by the melt flow into the mold or to overcome the problem of uneven lead distributions.

SUMMARY OF THE INVENTION

One object of the present invention is to provide a method of continuously casting lead-bearing steel which overcomes the aforesaid drawbacks of the prior art.

A more specific object of the invention is to provide a method of continuously casting lead bearing steel which prevents variations in Pb content over the time course of the casting operation and enables production of a continuously cast strand which exhibits uniform Pb distribution and is free from course Pb grains.

Upon comparing the conventional methods of adding lead to steel in the production lead-bearing steel, the inventors discovered that where the lead-bearing steel is produced by continuous casting, the method of addition of the lead to the molten steel in the tundish gives relatively good results as regards both uniform Pb addition over the time course of the casting operation and uniform addition over the strand cross-section. In view of this finding, the inventor carried out a detailed study concerning addition of lead to the molten steel in the tundish and as a result achieved the present invention.

For achieving the aforesaid object, the present invention provides a method of continuously casting lead-bearing steel by adding lead to molten steel in a tundish wherein the tundish is divided into a plurality of chambers including a melt receiving chamber and an immersed nozzle chamber, Pb is supplied to molten steel in a chamber other than the immersed nozzle chamber so as to form a lead sediment layer at the bottom thereof, and molten steel containing suspended Pb is passed to the immersed nozzle chamber from where it is poured into a mold of the continuous caster.

The above and other features of the present invention will become apparent from the following description made with reference to the drawings.

DESCRIPTION OF THE PREFERRED EMBODIMENT

Figure 1:
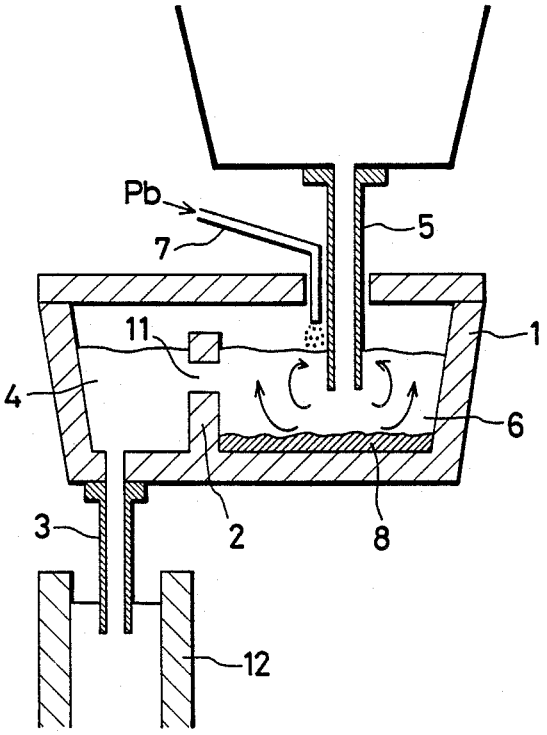
FIGS. 1–3 are sectional side views of apparatuses for carrying out the method of the present invention.

FIG. 1 shows an example in which a tundish 1 is provided with a barrage or barrier 2 which divides it into an immersed nozzle chamber 4 provided with an immersed nozzle 3 and a melt receiving chamber 6 which receives melt from a long nozzle 5.

Lead (Pb) is supplied to the chamber other than the immersed nozzle chamber 4, namely to the melt receiving chamber 6, via a supply apparatus 7. The so-supplied Pb forms a Pb sediment layer 8 at the bottom of the melt receiving chamber 6, while the agitating action of a melt flow from the long nozzle 5 causes fine particles of Pb at the upper part of the sediment layer 8 to assume a suspended state but leaves the coarser particles of the Pb at the bottom of the melt receiving chamber 6.

The barrage 2 prevents lateral fow of the melt at the bottom region of the melt receiving chamber 6 but permits the melt to flow through an opening 11 at the upper region thereof. Thus flow of the sediment layer 8 is prevented by the barrage or barrier 2. The melt with the suspended fine particles of Pb flows through the opening 11 into the immersed nozzle chamber 4 and then passes through the immersed nozzle 3 into a mold 12.

The barrage or barrier 2 causes a suspension of fine Pb particles in the melt to be formed above the sediment layer 8 and further functions to separate the melt receiving chamber 6, which has a sediment of coarse Pb particles at the bottom thereof, from the immersed nozzle chamber 4 for feeding fine Pb particles to the mold 12.

To ensure that the coarse Pb particles will be prevented from flowing into the immersed nozzle chamber 4, the opening 11 must be located above the sediment layer 8 and should preferably be located as high as possible. On the other hand, for preventing undissolved Pb on the surface of the melt from passing into the immersed nozzle chamber 4, the opening 11 should be located below the surface of the melt.

Figure 2:
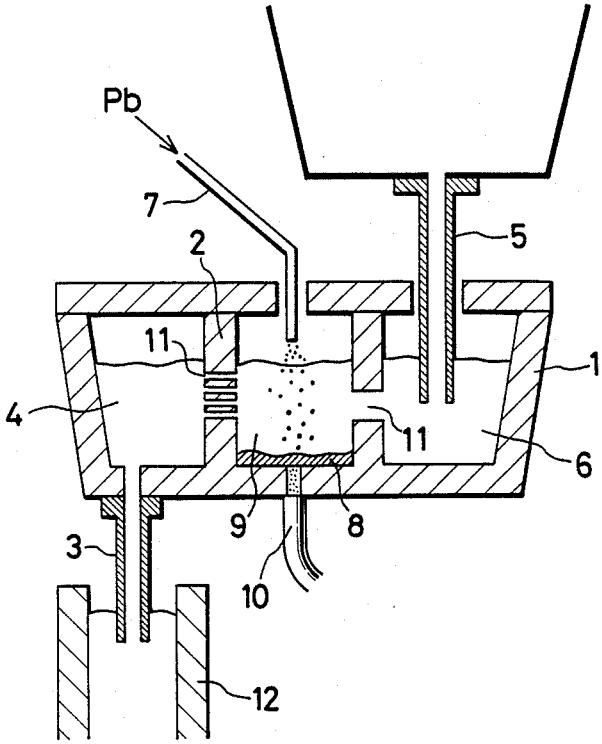

FIG. 2 shows an example in which two barrages 2 are provided to partition the tundish into three chambers, with an intermediate chamber 9 being formed between an immersed nozzle chamber 4 and a melt receiving chamber 6. The advantage of this arrangement is that the lead-in-melt suspension can be formed by blowing is Ar gas through a gas injection inlet 10 in the bottom of the tundish 1. In this case, for preventing coarse particles of Pb floated up by blown-in Ar gas from passing into the immersed nozzle chamber 4, it is preferable to provide a plurality of openings 11 on the side of the immersed nozzle chamber 4 and to make each opening of such a small diameter that any effect of the upcurrent caused by the blown-in Ar gas is precluded.

Figure 3:
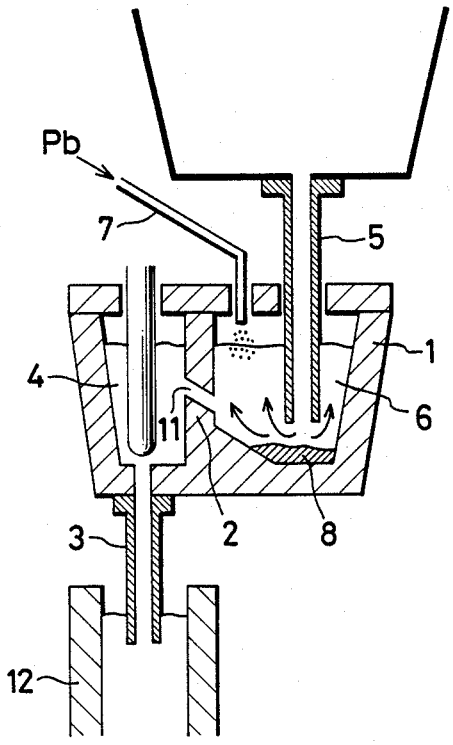

FIG. 3 shows a case where the tundish 1 is divided into two chambers, a melt receiving chamber 6 and an immersed nozzle chamber 4, and special consideration is given to facilitating the formation of a lead-in-melt suspension by the agitating action that a stream of inflowing melt from a long nozzle 5 has on a Pb sediment layer 8.

More specifically, the area of the sediment layer 8 on the floor of the tundish is narrowed to within the range to which the effect of the stream of melt from the long nozzle 5 extends. Further, the floor of the tundish is provided with a sloped portion so as to facilitate formation of a Pb suspension and obtain an upcurrent.

While the above examples relate to production of a single strand, it should be noted that a plurality of strands of lead-bearing steel can be produced by a similar method.

Comparative EXAMPLE 1

In production of SUS 304 loom in a square of 150 mm by continuous casting, Pb was added to the tundish so as to obtain stainless steel containing 0.2% Pb. The tundish used was box-shaped and flat-bottomed. It had a capacity of 4.2 tons and was not provided with a barrage.

After 2 tons of melt had been introduced into the tundish, Pb was continuously supplied to the metal surface by injection type feeder. The rate of Pb addition was five times that of the target value of 0.2% for the strand. Namely, while molten steel was poured from the long nozzle at the rate of 280 kg/min, lead was added at the rate of 1.0 % of this amount, i.e. at the rate of 2.8 kg/min.

When the contents of the tundish had reached the normal level of 4.2 tons, drawing was begun to obtain a casting speed of 1.6 m/min (280 kg/min). The mean Pb content of the strand at a point corresponding to 5 minutes after the start of casting was 0.05%, while that at a point corresponding to 30 minutes after the start of casting was 0.14%.

A 30 mm-thick cross-sectional sample was cut from the strand at a point corresponding to 30 minutes after the start of casting. Examination of this sample by x-ray photography showed that its center region contained coarse grains of Pb measureing 0.1 mm or more in diameter, with the largest of the grains measuring 7 mm in diameter.

EXAMPLE 1

In continuous casting SUS 304 bloom, there was produced 0.2% lead-bearing steel. In accordance with the arrangement shown in FIG. 1, the tundish 1 was divided by the barrage 2 into the immersed nozzle chamber 4 and the melt receiving chamber 6, and Pb was supplied from the vicinity of the long nozzle 5.

To ensure that the Pb content of the strand would fall within the prescribed range at the start of continuous casting, a large amount of Pb was added immediately after pouring of melt into the tundish was started so as to form an adequate initial Pb sediment layer. The amount of Pb that had to be added in order to obtain a strand with a Pb content falling within the prescribed range was determined experimentally beforehand taking into consideration the shape of the tundish, the thickness of the Pb sediment layer and the flow of melting in the tundish.

More specifically, after 2 tons of melt had been poured into the tundish, 48 kg of Pb was divided into batches and supplied to the melt receiving chamber, thereby forming the Pb sediment layer 8 on the floor of the tundish. The flow of melt from the long nozzle 5 caused a lead-in-melt suspension to be formed above the sediment layer.

When the amount of melt in the tundish had reached 4 tons, drawing was commenced to obtain a casting speed of 1.6 m/min. Simultaneously with the start of casting, injection of Pb to the surface of the melt in the melt receiving chamber was commenced at the rate of 1.4 kg/min. This supply of lead was continued throughout the continuous casting operation.

Given that when Pb is supplied by injection type feeder it is possible to avoid the flow of course Pb particles directly into the mold, it is preferable to carry out the injection of lead at a point somewhat removed from the opening and to make the area of the sediment layer large so that the coarse Pb particles can settle to the bottom.

The mean Pb content of the strand at a point corresponding to 5 minutes after the start of casting was found to be 0.22%, while that at a point corresponding to 30 minutes after the start of casting was 0.19%. It was thus possible to produce lead-bearing bloom with a lead content close to the target value of 0.20%. Examination of the distribution of coarse Pb grains by X-ray photography showed that no coarse grains of a diameter of 0.1 mm or larger were formed at any part of the strand.

EXAMPLE 2

SUS 304 bloom containing 0.3% Pb was produced by continuous casting using an arrangement like that shown in FIG. 2. That is to say, two barrages 2 were provided to divide the interior of the tundish into three compartments. Pb was supplied to the intermediate chamber 9 while Ar gas was also blown into the same chamber from below through porous brick 10 at the bottom of the tundish. After 3 tons of melt had been poured into the tundish, 108 kg of Pb was added thereto in batches to form a Pb sediment layer 8 on the floor of the tundish. At the same time, blowing-in of Ar through the porous brick was begun so as to form a lead-in-melt suspension above the sediment layer 8.

When the amount of melt in the tundish had reached 5.4 tons, drawing was started to obtain a continuous casting speed of 1.6 m/min. At the same time, injection of Pb to the intermediate chamber was begun and continued at the rate of 2.5 kg/min. The Pb content of the resulting strand was found to fall in the range of 0.28–0.33% in both the longitudinal and transverse directions of the strand. Moreover, no formation of coarse Pb grains was observed under examination by X-ray photography.

EXAMPLE 3

To SUS 420 steel, in which lead exhibits lower solubility as compared with SUS 304 steel, lead was added to obtain a target content of 0.15%. The tundish had a single barrage or barrier 2 of the type shown in FIG. 3, and the tundish was arranged such that the Pb sediment layer 8 was positioned directly below the long nozzle 5, whereby a lead-in-melt suspension was formed above the Pb sediment layer 8.

When the amount of melt in the tundish had reached 1.5 tons, 27 kg of Pb was added thereto batchwise. Then when the amount of melt had reached 2.9 tons, continuous addition of Pb at 1.3 kg/min was begun and, at the same time, drawing was started to obtain a casting speed of 1.6 m/min. The Pb content of the so-produced strand was 0.12–0.16% in both the longitudinal and cross-sectional directions. Thus the Pb content of the strand was close to the target value of 0.15%. No formation of coarse Pb grains was observed.

By the method of the present invention it is thus possible to carry out continuous casting of lead-bearing steel in such manner that only slight variations in Pb content arises over the course of the casting operation and that the strand as obtained exhibits uniform Pb content without the present of coarse Pb grains.

What is claimed is:

1. A method of continuously casting lead-bearing steel comprising the steps of:

providing a tundish having a barrage therein for dividing said tundish into at least a melt-receiving chamber and an immersed nozzle chamber, an immersed nozzle opening in said immersed nozzle chamber for passing molten lead-bearing steel therethrough into a mold, and an upwardly inclined opening in an upper portion of said barrage for leading a lead-in-melt suspension of lead-bearing steel upwardly therethrough from at least said melt-receiving chamber into said immersed nozzle chamber;

supplying molten steel into at least said melt-receiving chamber;

supplying lead into one of the said chambers other than said immersed nozzle chamber for forming a lead sediment layer at the bottom of the said other chamber for forming a lead-bearing molten steel; and causing the lead-bearing molten steel to pass through said upwardly inclined opening from said at least said melt-receiving chamber into said immersed nozzle chamber for passing through said immersed nozzle opening for pouring into a mold.

2. A method as in claim 1, further comprising the step of directing the supplying of molten steel in the molten steel supplying step toward the lead sediment layer at the bottom of the said other chamber for agitating the lead sediment layer fo facilitating the forming of the lead-bearing steel.

3. A method of continuously casting lead-bearing stainless steel comprising the steps of:

providing a tundish having a barrage therein for dividing said tundish into at least a melt-receiving chamber and an immersed nozzle chamber, an immersed nozzle opening in said immersed nozzle chamber for passing molten lead-bearing stainless steel therethrough into a mold, and an upwardly inclined opening in an upper portion of said barrage for leading a small particle lead-in-melt suspension of lead-bearing stainless steel having in excess of the soluble amount of lead in the molten stainless steel therethrough upwardly from at least said melt-receiving chamber into said immersed nozzle chamber;

supplying molten stainless steel into at least said melt-receiving chamber;

supplying a sufficient quantity of lead into one of the said chambers other than said immersed nozzle chamber for forming a lead sediment layer at the bottom of the said other chamber for forming a small particle lead suspension in excess of the soluble amount of lead in the stainless steel for forming a lead-bearing molten stainless steel; and causing the lead-bearing molten stainless steel to pass through said opening from said at least said melt-receiving chamber into said immersed nozzle chamber for pouring into a mold.

* * * * *